US006715276B2

(12) United States Patent
Matsuoka et al.

(10) Patent No.: US 6,715,276 B2
(45) Date of Patent: Apr. 6, 2004

(54) FALSE TWIST YARNS AND PRODUCTION METHOD AND PRODUCTION DEVICE THEREFOR

(75) Inventors: Hiroshi Matsuoka, Ishikawa (JP); Sadao Matsuki, Ishikawa (JP); Tatsuaki Matsuda, Ishikawa (JP); Kouichi Satou, Sizuoka (JP); Genshin Nakazawa, Ishikawa (JP)

(73) Assignee: Toray Industries, Inc. (JP)

( * ) Notice: Subject to any disclaimer, the term of this patent is extended or adjusted under 35 U.S.C. 154(b) by 132 days.

(21) Appl. No.: 09/980,997

(22) PCT Filed: Mar. 22, 2001

(86) PCT No.: PCT/JP01/02252

§ 371 (c)(1),
(2), (4) Date: Nov. 5, 2001

(87) PCT Pub. No.: WO01/71072

PCT Pub. Date: Sep. 27, 2001

(65) Prior Publication Data

US 2003/0041586 A1 Mar. 6, 2003

(30) Foreign Application Priority Data

Mar. 24, 2000 (JP) ..... 2000-083743
Mar. 24, 2000 (JP) ..... 2000-083744

(51) Int. Cl.[7] ..... D01H 1/11
(52) U.S. Cl. ..... 57/246; 57/288; 57/332
(58) Field of Search ..... 57/243–246, 248, 57/332–349, 351, 284–291; 242/478.3, 478.4, 478.5, 478.6, 478.7, 478.8, 478.9, 479, 479.1; 428/364, 365, 369, 370, 397

(56) References Cited

U.S. PATENT DOCUMENTS 4,300,345 A * 11/1981 Kasai et al. ..... 57/290
4,578,940 A * 4/1986 Negishi et al. ..... 57/289
5,404,706 A * 4/1995 Ueno et al. ..... 57/290
5,459,991 A * 10/1995 Nabeshima et al. ..... 57/287
5,462,790 A * 10/1995 Matsuki et al. ..... 442/195
5,725,167 A * 3/1998 Garwood et al. ..... 242/478.5

FOREIGN PATENT DOCUMENTS

JP 49-132353 12/1974
JP 59-130336 7/1984
JP 60-252738 12/1985
JP 01-183540 7/1989
JP 01-314740 12/1989
JP 09-250034 9/1997

* cited by examiner

*Primary Examiner*—John J. Calvert
*Assistant Examiner*—Shaun R Hurley
(74) *Attorney, Agent, or Firm*—Piper Rudnick LLP

(57) ABSTRACT

A false twist yam including synthetic fiber yam having elongation, crimp rigidity, crimp appearance stretch ratio, dry heat shrinkage stress maximum value, deformation degree of single filament and entanglement number in specific ranges respectively. The yam has good drape properties, soft feeling, bulkiness, and flexibility as well as puff properties, mild luster, and pliable dry feeling. From the yam, woven or knit fabrics having novel texture that cannot be achieved in woven or knit fabrics produced from conventional drawn or false twist yams. The false twist yam is produced in a drawing and false twisting process.

14 Claims, 8 Drawing Sheets

FALSE TWIST YARNS AND PRODUCTION METHOD AND PRODUCTION DEVICE THEREFOR

TECHNICAL FIELD

The present invention relates to a false twist yam, a production method thereof, and a production apparatus thereof.

False twist yams of the invention have little cross sectional deformation, and have such features as good drape properties, soft feeling, bulky feeling, and lightweight feeling, as well as a desirable degree of stretch, strong-kneed, and repulsion feeling. A cloth comprising false twist yarns of the invention has mild luster that cannot be achieved with conventional yarns, and possesses a smooth, dry feeling.

BACKGROUND ART

With good mechanical and other properties, synthetic fibers have been used in goods in a large variety of fields including ordinary apparel.

Efforts in the field of apparel production have been made with the aim of providing improved synthetic fibers that are similar to natural material. Drawn yarns, in particular, tend to lack bulkiness, and to solve this problem, improved false twist yarns have been developed and manufactured in a process in which yarns are false-twisted while being drawn to achieve a desirable bulkiness.

To provide lightweight material, hollow fibers that consist of hollow single yarns have been developed and manufactured.

To provide fabrics having dry-feeling by reducing contact area between filaments, filament having a noncircular cross section of which the peripheral figure is wavy, have been manufactured. However, there are limits to being able to produce such a wavy form by a spinning process. If such filaments having noncircular cross section are false-twisted to produce false twist yarn, woven or knit fabric manufactured from the false twist yarns tends to have problems such as sandy touchable feeling or lack of soft feeling. In addition, the wavy form is deformed largely during the false twisting process, preventing the wavy form from having good effect on the resultant woven or knit fabrics.

False twist yarn produced by false twisting hollow filaments tend not to achieve required lightweight properties because of substantial destruction of hollow portions.

False twisting has to be performed at a high temperature to produce material that maintains sufficient bulkiness and crimp properties, but high-temperature processing tends to reduce the shrinkage percentage of the resultant false twist yarn.

JP 01-314740 A discloses a technique that aims to widen the range of the shrinkage percent level and reduce the cross sectional deformation of the resultant yarn. JP 01-183540 A discloses a technique that aims to produce high density woven fabric from a yarn having a small cross sectional deformation and a high shrinkage.

Under these techniques, however, filaments are false-twisted while being heated below the glass transition temperature, and therefore the techniques are low in productivity for false twist yarn and are not suited for commercial production.

In most conventional processes for out-drawing and false texturing or in-drawing and false texturing of synthetic fiber yarn, a twisted yarn is heated first, and then drawn, twisted, and heat-set, followed by untwisting.

In the conventional false twisting processes described above, a false twisting apparatus comprising a feed roller, a take-up roller, a heating plate provided between both rollers and a means of false twisting, is used.

If the false twist processing speed is increased in the false twisting apparatus, the twisting tension increases or the yarn is twisted on the heating plate, and an extension break of single filament in the yarn or a heat deterioration of the yarn that results in fluffing or scission of filaments is observed. It becomes necessary to extend the length of the heating plate to compensate for reducing the heat setting time.

To solve this problem, JP 09-20034 A proposes a method in which a yarn is entangled before being fed to a false twisting apparatus, and heated before being twisted by using a feed roller as a heating roller, followed by false twisting which is performed by using a nip roll as disclosed in JP 49-132353 A in such a manner that twisting starts at the end point of heating on the heating roller.

In this method, however, the starting point of twisting on the yarn is in contact with the surface of the heater, and the nip roll is used, which tends to cause problems such as heat deterioration and abrasion of the yarn on the surface of the heater, and wearing and deterioration of the nip roll which will result in retroaction of twist toward the heating roller and, in turn, fluffing and scission of the yarn. These problems can be very serious in the case of a yarn comprising ultra fine filaments or a synthetic fiber yarn comprising filaments having a special cross sectional shape.

Furthermore, a false twist yarn produced by the conventional process has a high crimp appearance property, and where a cloth is produced from such yarn, shrinkage of the yarn takes place at the time of appearance of crimps during the process of relaxation, presetting, denier reduction or dyeing, causing deterioration in drape properties, bulkiness, or soft feeling.

To solve these problems, the so-called "double-heating false twisting" process has been widely used, in which the yarn is false-twisted by the above-mentioned conventional technique, followed by further heat-setting of the resultant yarn using a heating plate.

Each of JP 59-130336 A and JP 60-252738 A discloses a technique in which an undrawn polyester yarn is false-twisted at a low temperature.

Each method, however, cannot solve the problem of the deterioration in drape properties, bulkiness, or soft feeling of fabrics due to shrinkage that takes place during the development of crimps.

In most conventional processes for production of synthetic fiber yarns, particularly drawn ones, a spindle-type winder is used to wind up the yarn in a pirn form on a bobbin in order to improve the pulling or rewinding properties of the yarn at the time of pulling out yarn from the bobbin to feed it to a twisting process or a weaving machine. In such a pirn-winding bobbin, a top pirn wind is formed at a top portion of the bobbin away from the pirn portion so that a location of the end of the yarn is found easily when using the bobbin.

When a top pirn wind is formed after winding up a false twist yarn in a pirn form, however, the yarn processing speed is decreased and the heat history of the yarn is affected during the formation of the top pirn wind, resulting in coexistence of yarns with different crimp properties. Thus, yarns with undesirable crimp properties have to be removed, causing a problem with the need of a complicated production process.

DISCLOSURE OF THE INVENTION

An object the present invention is to provide a false twist yarn that is free from the above-mentioned disadvantages of the conventional art, and is able to serve to produce woven fabrics or knit fabrics (hereinafter referred to as "woven/knit fabrics") that have such features as good drape properties, soft feeling, bulkiness, and lightweight properties, as well as rich in stretch, kneed and repulsion feeling and can form cloth with mild luster and a smooth, dry feeling to achieve a feeling different from conventional drawn or false twist yarns, and a production method and a production apparatus therefor.

To accomplish that object, a false twist yarn of the invention consists of (i) a synthetic fiber yarn and has the following properties (ii)–(vii).

(ii) an elongation (EL) of not less than 20% and not more than 50%, (iii) a crimp rigidity (CR) of not less than 10% and not more than 40%, (iv) a crimp appearance stretch ratio (TR) of not less than 0.5% and not more than 15%, (v) a dry heat shrinkage stress maximum value (MCS) of not less than 0.1 cN/dtex and not more than 1.0 cN/dtex, (vi) a deformation degree of single filament (SDD) of not less than 1.0 and not more than 2.5, and (vii) an entanglement number (EN) of not less than 4 and not more than 50.

It is preferable that the false twist yarn of the invention has a real twist number (RT) of not less than 4 t/m (turns/meter) and not more than 15 t/m.

It is preferable that each of filaments forming not less than 30% of the false twist yarn of the invention has a hollow percentage (HR) of not less than 6% and not more than 15%.

It is preferable that the false twist yarn of the invention comprises a mixture of filaments whose peripheral profile of cross section has no concave portions and whose peripheral profile of cross section has concave portions, the deformation degree (SDD) of the filaments having no concave portions being not less than 1.0 and not more than 2.0, and a deformation degree (SDD) of the filaments having concave portions being not less than 1.6 and not more than 2.5.

It is preferable that the false twist yarn of the invention is wound up in a pirn form on a bobbin and the starting portion of winding of the yarn and the finishing portion of winding of the yarn are held by at least one yarn gripping means provided on the bobbin.

To accomplish that object, a method for producing a false twist yarn according to the invention is as follows.

A method for producing a false twist yarn comprises (i) an undrawn yarn feeding process that feeds an undrawn synthetic fiber yarn, (ii) a drawing and false twisting process that draws and false-twists the undrawn yarn fed from the undrawn yarn feeding process, and (iii) a false twist yarn winding process that winds up the false twist yarn produced by drawing and false twisting performed in the drawing and false twisting process, wherein (iv) the drawing and false twisting process contains a heater, a false twisting means, and a twist stopping means provided between the heater and the false twisting means, the undrawn yarn is heated by the heater while twisting motion imparted by the false twisting means on the undrawn yarn is restrained by the twist stopping means, and subsequently the heated undrawn yarn, after passing through the twist stopping means, is false-twisted by the false twisting means with a starting point of twisting formed by the twist stopping means.

It is preferable that in the method for producing a false twist yarn of the invention, an entangling process that imparts tangles of filaments in the undrawn yarn, before the heating of the undrawn yarn by the heater is provided.

It is preferable that in the method for producing a false twist yarn of the invention, the fineness of filament (SD) in the undrawn yarn is not more than 1.2 dtex.

It is preferable that in the method for producing a false twist yarn of the invention, the undrawn yarn comprises at least two types of filaments with different cross sectional shapes.

It is preferable that in the method for producing a false twist yarn of the invention, a reheating process in which the yarn after passing through the twist stopping means is reheated between the twist stopping means and the false twisting means is provided.

It is preferable that in the method for producing a false twist yarn of the invention, a spindle having a vertical rotation axis, a bobbin mounted on the spindle, a yarn guide that rotates outside the bobbin to guide the false twist yarn onto the bobbin and a traverse guide that moves the yarn guide up and down along the rotation axis of the spindle to form a pirn on the bobbin and that produces yarn end portions on the bobbin at the starting and finishing of winding of the false twist yarn are provided in the false twist yarn winding process, and the starting and finishing portions of the false twist yarn are held by a yarn gripping means provided on the bobbin at positions corresponding to the positions of the starting and finishing portions of winding of the false twist yarn.

To accomplish that object, an apparatus for producing a false twist yarn according to the invention is as follows.

An apparatus for producing a false twist yarn comprises (i) an undrawn yarn feeding means that feeds undrawn synthetic fiber yarns, (ii) a drawing and false twisting means that draws and false twists the undrawn yarns fed from the undrawn yarn feeding means, and (iii) a false twist yarn winding means that winds up the false twist yarn produced by the drawing and false twisting performed by the drawing and false twisting means, wherein (iv) the drawing and false twisting means contains a heater, a false twisting means, and a twist stopping means provided between the heater and the false twisting means, the undrawn yarn is heated by the heater while twisting motion imparted by the false twisting means on the undrawn yarn is restrained by the twist stopping means, and subsequently the heated undrawn yarn, after passing through the twist stopping means, is false-twisted by the false twisting means with a starting point of twisting formed by the twist stopping means.

It is preferable that in the apparatus for producing a false twist yarn of the invention, an entangling means that imparts tangles of filaments in the undrawn yarn, is provided at a position before the heating of the undrawn yarn by the heater.

It is preferable that in the apparatus for producing a false twist yarn of the invention, a reheating means in which the yarn after passing through the twist stopping means is reheated between the twist stopping means and the false twisting means is provided.

It is preferable that in the apparatus for producing a false twist yarn of the invention, the false twist yarn winding means includes a spindle having a vertical rotation axis, a bobbin mounted on the spindle, a yarn guide that rotates outside the bobbin to guide the false twist yarn onto the bobbin, and a traverse guide that moves the yarn guide up and down along the rotation axis of the spindle to form a pirn on the bobbin and that produces yarn end portions on the bobbin at the starting and finishing of winding of the false twist yarn, and the starting and finishing portions of the false twist yarn are held by a yarn gripping means provided on the bobbin at positions corresponding to the positions of the starting and finishing portions of winding of the false twist yarn.

THE BEST EMBODIMENT FOR PRACTICING THE INVENTION

Figure 1:
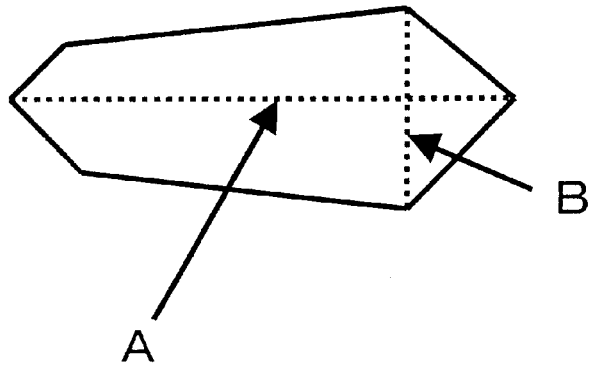
FIG. 1 is a cross sectional plan view of a filament to assist in explaining the definition of the degree of deformation of cross section of a filament in a false twist yarn of the invention.

A synthetic fiber yarn of the invention is a synthetic fiber yarn that is possible to draw in heat such as polyester and polyamide fiber yarns. A polyester fiber yarn is preferable, since it is used widely.

A false twist yarn according to the invention has an elongation (EL) of not less than 20% and not more than 50%. If the elongation (EL) is less than 20%, the resultant false twist yarn will have fluff, making it difficult for the yarn to smoothly pass through processes such as weaving. If the elongation (EL) exceeds 50%, sufficient orientation and sufficient strength will not be achieved. To provide material with special soft feeling, it is preferable that the elongation (EL) is not less than 23% and not more than 40%, more preferably not less than 25% and not more than 40%.

Method for measuring the elongation (EL)(unit: %):

This measurement is performed according to JIS L-1090. Thus, tensile test is conducted with a Tensilon tensile tester for a 20 cm long specimen at a stretching rate of 20 cm/min under an initial load of 0.088×fineness (dtex) cN. The elongation (EL) is defined with an elongation (%) at the maximum.

A false twist yarn of the invention has a crimp rigidity (CR) of not less than 10% and not more than 40%. It is preferable that the crimp rigidity (CR) is not less than 12% and not more than 35%, more preferably not less than 12% and not more than 33%. If the crimp rigidity (CR) is less than 10%, woven or knit fabrics will not have sufficient stretch properties or bulkiness. If crimp rigidity (CR) is more than 40%, yarns resulting from dyeing and finishing processes will be too large in stretchability, and structures in the woven/knit fabric will change largely, making it impossible to achieve a soft feeling.

Method for measuring the crimp rigidity (CR)(unit: %):

This measurement is performed according to JIS L-1019T. Thus, a sizing reel is used to produce a hank having a length of 50 cm and the winding number of 10 under an initial tension of 0.088×fineness (dtex) cN. Then the hank is immersed in hot water having a temperature of 90° C. for 20 minutes, and water is removed with a blotting-paper or cloth, followed by air drying while holding the hank in a horizontal position. The hank is then put in water at room temperature, and the length "a" of the specimen is measured under required initial and constant loads. Then the constant load is removed, and the specimen is left in water under the initial load alone for 3 minutes, followed by the determination of the length "b" of the specimen. The crimp rigidity (CR) (%) is calculated by the following equation. Equations to calculate the initial and constant loads are also shown below.

$$CR\ (\%)=((a-b)/a)\times 100$$

Initial load ($cN$)=(fineness (dtex)/1.111)×0.002×0.9807×wind number×2

Constant load ($cN$)=(fineness (dtex)/1.111)×0.1×0.9807×wind number×2

A false twist yarn of the invention has a crimp appearance stretch ratio (TR) of not less than 0.5% and not more than 15%. It is preferable that the crimp appearance stretch ratio (TR) is not less than 0.6% and not more than 10%, more preferably not less than 0.6% and not more than 0.8%. If the crimp appearance stretch ratio (TR) is more than 15%, woven/knit fabric resulting from the dyeing and finishing process will have an excessive number of crimps, leading to deterioration of the soft feeling of the woven/knit fabric. If the crimp appearance stretch ratio (TR) is less than 0.5%, crimps after weaving or knitting will be small and a bulky feeling of the woven/knit fabric will be reduced.

Method for measuring the crimp appearance stretch ratio (TR) (unit: %):

A sizing reel is used to produce a hank with a length of 50 cm and the winding number of 20 under an initial tension of 0.088×fineness (dtex) cN. Then the hank is dry-heated under an initial load at a temperature of 150±2° C. for 5 minutes. After the dry-heating, the length "a" of the specimen under the initial load is measured. Then the initial load is removed, and the length "b" of the specimen under the constant load is measured. The crimp appearance stretch maximum ratio (TR) (%) is calculated from the following equation. Equations to be used to calculate the initial and constant loads are also shown below.

$TR\ (\%)=((b-a)/b)\times 100$

Initial load ($cN$)=(fineness (dtex)/1.111)×0.00166×0.9807×wind number×2

Constant load ($cN$)=(fineness (dtex)/1.111)×0.1×0.9807×wind number×2

A false twist yarn of the invention has a dry heat shrinkage stress maximum value (MCS) of not less than 0.1 cN/dtex and not more than 1.0 cN/dtex. It is preferable that the dry heat shrinkage stress maximum value (MCS) is not less than 0.1 cN/dtex and not more than 0.5 cN/dtex, more preferably not less than 0.1 cN/dtex and not more than 0.3 cN/dtex. If the dry heat shrinkage stress maximum value (MCS) exceeds 1.0 cN/dtex, woven/knit fabrics resulting from the dyeing and finishing process will be excessively contracted and poor in soft feeling. If the dry heat shrinkage stress maximum value (MCS) is less than 0.1 cN/dtex, shrinkage of fabrics resulting from the dyeing and finishing process will be small and the stretch and kneed of woven/knit fabrics will be lost.

Method for measuring the dry heat shrinkage stress maximum value (MCS) (unit: cN/dtex):

With a Kanebo Engineering Ltd. Type KE-2S heat stress gauge, an initial load of 0.088 cN/dtex is applied to a piece of string after that the piece is heated at a heating rate of 2.5° C./sec. During the heating, the stress generated in the piece is recorded on a chart. The maximum contraction stress in cN/dtex is calculated by dividing the stress determined from the chart by the fineness degree of the piece.

A false twist yarn of the invention has a deformation degree of single filament (SDD) not less than 1.0 and not more than 2.5. The deformation degree of single filament (SDD) is preferably not less than 1.0 and not more than 1.7, more preferably not less than 1.0 and not more than 1.5. If the deformation degree of single filament (SDD) exceeds 2.5, the advantage of the cross sectional shape of the raw yarn will be reduced. The false twist yarn may be made up of filaments having a circular cross section or a cross section deformed from a circular shape, or a mixture thereof. The advantage of the characteristic of the raw yarn is maintained since the processed yarn dose not suffer a significant deformation degree.

Definition of the deformation degree of single filament (SDD):

Deformation degree of single filament (SDD)=the longest length (long axis) in a cross section of filament (on the axis A shown in FIG. 1)/the widest wide (on the axis B shown in FIG. 1) relative to the long axis (the axis A) in the cross section of filament.

False twist yarns of the invention are low in degree of crimp. Their entanglement number (EN) is not less than 4 and not more than 50. The entanglement number (EN) is preferably not less than 5 and not more than 45, more preferably not less than 6 and not more than 40. If the entanglement number (EN) exceeds 50, tangles of filaments remain after the dyeing and finishing process, leading to deterioration in product quality. If it is less than 4, the yarn suffers a decrease in the pulling property and productivity is reduced on feeding it to a twisting process or a weaving machine.

Method for measuring the entanglement number (EN):

The number is measured with a Rothschild Co. Model R-2040 Entanglement Tester in accordance with JIS L-1013 (1992).

It is preferable that a false twist yarn of the invention has a real twist number (RT) of not less than 4 turns/meter and not more than 15 t/m. The real twist number (RT) is more preferably not less than 4 t/m and not more than 14/m, further more preferably not less than 4 t/m and not more than 13/m. It brings compactness of multi-filament together with entanglements between filaments. If the number of real twist number (RT) exceeds 15 t/m, after dyeing and finishing processes movement of filaments becomes insufficient and the soft feeling property is reduced.

To provide a lightweight product, it is preferable that a false twist yarn of the invention is produced from undrawn synthetic fiber yarn having a hollow percentage (HR) of not less than 15%. If the hollow percentage (HR) is less than 15%, the resultant product will not have sufficient puff properties, and will not serve to produce required fabric for apparel. A high hollow percentage (HR) is generally desirable to achieve the desired puff properties, but it is preferable that it is not more than 40%. If the hollow percentage (HR) exceeds 40%, the coloring properties deteriorate and hollow portions are destroyed, leading to a deterioration in product quality.

It is preferable that filaments of not less than 30% of the false twist yarn of the invention each of which has a hollow percentage (HR) of not less than 6% and not more than 15%, and the false twist yarn consists of a bundle of hollow filaments which has a randomized hollow percentage (HR) between the filaments. If the percentage of filaments having a hollow portion is less than 30% of the whole filaments, it becomes difficult to produce the desirable puffy properties. It also becomes difficult to produce desirable lightweight properties if the hollow percentage (HR) is less than 6%.

Method for measuring the hollow percentage (HR) (unit: %):

An undrawn synthetic fiber yarn or a false twist yarn is embedded in an embedding medium prepared from paraffin, stearic acid, and ethyl cellulose, and a section with a thickness of less than 5 $\mu$m is sliced off, followed by photographing of the cross section under a microscope. Then the photograph is cut into parts that either contain or do not contain a hollow portion, and their weight is measured. The hollow percentage (HR) is calculated by the following equation:

HR (%)=[(weight of hollow-containing parts)/(weight of hollow-containing parts+weight of hollow-free parts)]×100

It is preferable that for imparting a dry feeling to the false twist yarn of the invention, the yarn is produced from an undrawn synthetic fiber yarn consisting of multi-filament mixed with filaments having no concave portion in cross section and filaments having 2 to 8 concave portions in cross section. If the structuring filaments are a multi-filament consisting of filaments having only concave-free cross sections or mixed with filaments having one concave portion in cross section, it becomes difficult to impart a dry feeling and it is not enough to produce the desired fabric for apparel. In the case of filaments having concave portions of 9 or more, it is difficult to obtain a yarn consisting of such filaments by spinning. Undrawn yarn obtained by the spinning contains broken filaments. Furthermore, in this case, the figure of the cross section is close to a circle and spaces between filaments are reduced and therefore dry feeling is lost.

It is further preferable that in a false twist yarn of the invention, a mixing ratio of filaments having concave portions in cross section and filaments having no concave portions in cross section is in the range of 20:80 to 80:20, more preferably in the range of 40:60 to 60:40. If the ratio of filaments having concave portions is more than 80%, the resultant product has a sandy or coarse feeling. If the ratio is less than 20%, the resultant product has a wet and glistening feeling and becomes strong which is caused by the existence of filaments having no concave portions in cross section.

It is preferable that in a false twist yarn of the invention, a degree of deformation (hereinafter referred to as "the modifiability degree") (L/r) of a filament having a concave portion in cross section is not less than 1.6 and not more than 2.5 for imparting mild luster and pliable dry feeling on a fabric. The degree is more preferably not less than 1.6 and not more than 2.2, most preferably not less than 1.6 and not more than 2.0. If the modifiability degree (L/r) is less than 1.6, the degree of difference between concave and convex portions is reduced and spaces between filaments in the bundle to filaments are reduced, and therefore a dry feeling on a fabric is reduced. If the modifiability degree (L/r) exceeds 2.5, a fabric produced from the yarns has a glaring luster. Furthermore, convex portions are entangled with each other, or filaments having no concave portions are captured by the convex portions, and spaces between filaments in a bundle of filaments are closed and therefore a dry feeling is reduced.

Figure 2:
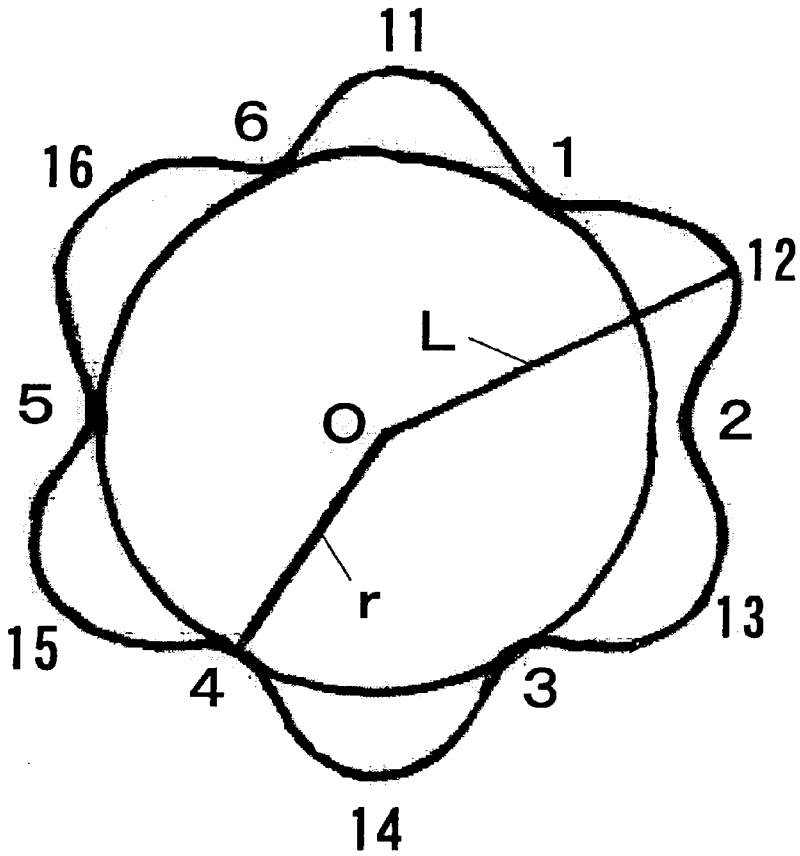
FIG. 2 is another cross sectional plan view of a filament to assist in explaining the definition of the degree of deformation of a cross section of a filament in a false twist yarn of the invention.

Definition of modifiability degree of filament (L/r):

In the equation L/r, "r" represents the radius of an inscribing circle R which has the largest area among all inscribing circles that pass over three arbitrary points in the concave portions (1–6) shown in FIG. 2.

"L" represents the length of the straight line that is the longest of all lines connecting the center (O) of the largest inscribing circle and each of the convex portions (11 to 16).

It is preferable that in a false twist yarn of the invention, the deformation degree of single filament (SDD) having no concave portions is not less than 1.0 and not more than 2.0, more preferably not less than 1.0 and not more than 1.7, most preferably not less than 1.0 and not more than 1.5. If the deformation degree of single filament (SDD) exceeds 2.0, spaces formed between filaments having concave portions are closed and a dry feeling is reduced. The cross section of filaments having no concave portions may be circle, ellipse, triangle, pseudo-circle with rounded vertexes, or polygon with more than three vertexes. Circle and ellipse cross sections are preferred.

A method and apparatus for producing a false twist yarn according to the invention will be described below.

Figure 3:
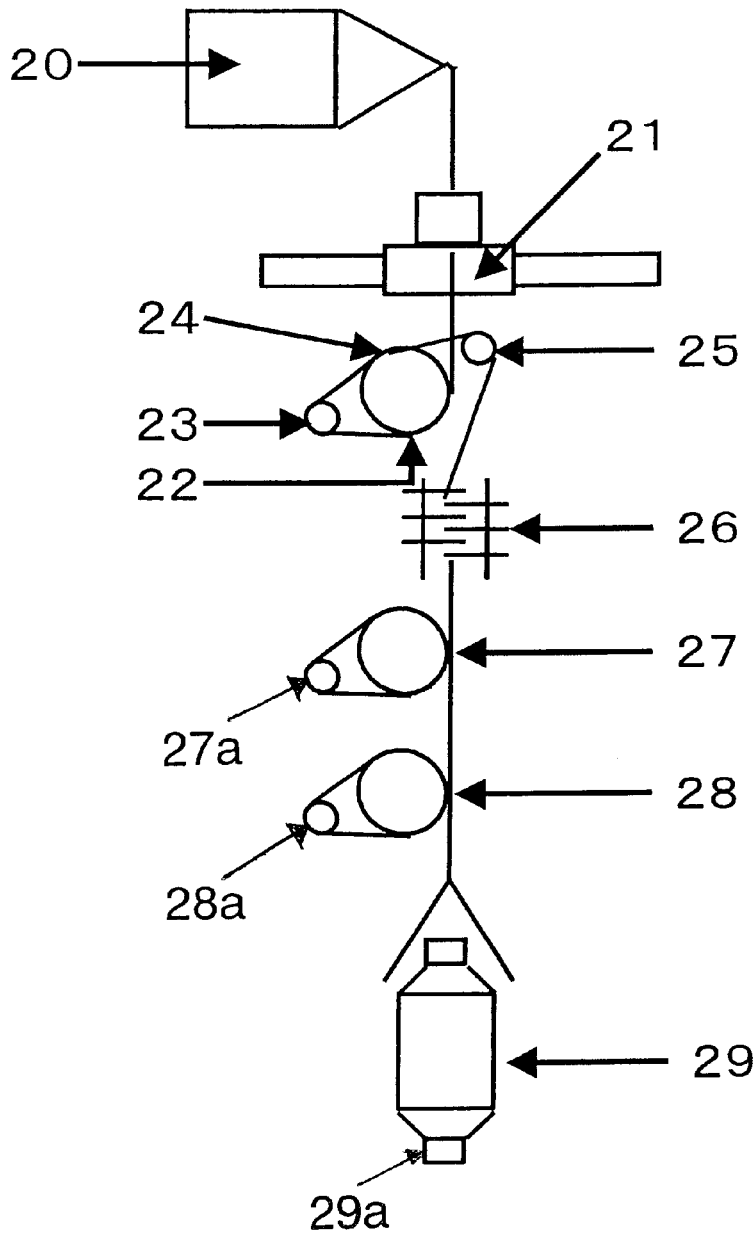
FIG. 3 is a schematic view of an apparatus for implementing a method for producing a false twist yarn of the invention.

In FIG. 3, an undrawn synthetic fiber yarn 20 passes through a feed roll 21, and is preheated by winding on between a heating roll 22 and a separating roll 23.

The preheated undrawn yarn 20 is continuously drawn and false-twisted between a twist stopping means 25, a false twisting means 26 and a take-up roll 27, including auxiliary roll 27*a*. Drawing is achieved between the twist stopping means 25 and the false twisting means 26.

Twisting achieved by the motion of the false twisting means 26 starts at the twist stopping means 25 which is provided at a position in the downstream side of a point 24, where the yarn is released from the heating roll 22, and between the heating roll 22 and the false twisting means 26.

Then, after passing an unheated stretch roll 28, including auxiliary roll 28*a*, the yarn which has been false-twisted is wound up in a pirn form on a bobbin 29*a*. Here, a pirn 29 of a false twist yarn of the invention is produced.

A continuous drawing and false twisting texturing may be either of an in-drawing and false texturing type as shown in FIG. 3 or of an out-drawing and false texturing type.

It is preferable that the undrawn synthetic fiber yarn 20 is an undrawn yarn produced by winding a melt-spun yarn at a wind-up speed of not less than 2,000 m/min and not more than 5,000 m/min. A wind-up speed of less than 2,000 m/min is disadvantageous in increasing the false twisting speed, whereas a wind-up speed of more than 5,000 m/min increases the number of filament breaks during false twisting.

As the twist stopping means 25 is provided on the downstream side of the point 24 where the yarn is released from the heating roll 22, the function of twisting imparted by the false twisting means 26 does not influence the yarn being heated on the heating roll 22. This allows the yarn to be heated on the heating roll without being twisted. As the result, all filaments in the yarn are sufficiently heated substantially uniformly.

As twisting starts at the position of twist stopping means 25, a retroaction of twist toward the heating roller 22 is prevented. Thus, the resultant false twist yarn is free from fluff or breakage of the filaments .

The fixation of twists is weak as the fixation is achieved by heat imparted to the yarn by the heating roll 22. Therefore, the resultant false twist yarn has not such a high crimp forming tendency in conventional false twist yarns, which leads to poor drape properties, bulkiness, and soft feeling. The false twist yarn provides woven/knit fabric having good drape properties, bulkiness and soft feeling and shows a novel texture that could not be achieved with conventional drawn yarns or false twist yarns.

The temperature of the heating roll 22 may be set appropriately in accordance with the kind of synthetic fiber yarn used, a required crimp quality or processing speed. However, it is preferable that the temperature is not lower than the glass transition temperature of the synthetic fiber yarn used to form the yarn.

A winding number of the yarn on the heating roll 22 may be set appropriately in accordance with a required heating value, but the number is preferably at least four in order to prevent slippage of the yarn.

By preparing the take-up roll 27 as a roll being able to heat, it becomes possible to heat-set the false-twisted yarn and it make possible to easily produce a double-heated false twist yarn.

The boiling water shrinkage percentage of the resultant false twist yarn can be increased as compared to conventional false twist yarns by setting the take-up roll 27 at an optimum heating temperature. If the false twist yarn with an optimum boiling water shrinkage percentage is additionally twisted and heat-shrunk, the number of twists per unit length will be increased to provide a false twist yarn with a high flexibility which is achieved by a spring effect. The number of additional twists may be set appropriately, but it is preferable that the number is selected in the ordinary range from 100 t/m to 2,000 t/m.

The twist stopping means 25, which is provided at the point where twisting starts, may be any device that can prevent the extension of twisting back to the heating roll 22. A conventional non-rotating guide such as a rod-type or rotating guide such as roller guide may be used.

The false twisting means 26 may be a conventional false twisting means such as a pin-type or three pivots friction disk type false twister. The use of a three pivots friction disk type or a belt-nip type false twister is preferred inasmuch as they make it possible to increase the processing speed. The number of twists that are given to the yarn by the false twisting means 26 may be set appropriately, but it is preferable that the number is in the range from 1,500 t/m to 4,500 t/m.

The yarn that has been false-twisted, i.e., twisted and subsequently untwisted, is taken up by the take-up roll 27 and the stretch roll 28, and wound up by a spindle wind-up machine into the pirn 29 on the bobbin 29*a*.

The use of a spindle wind-up machine to wind up the yarn into a pirn form is preferred to increase the pulling property (kaijosei) of the resultant false twist yarn to be fed from the bobbin to the subsequent twisting process or weaving machine.

To enhance the pulling property of the false twist yarn, it is further preferred to provide an air entangling nozzle (not shown in the drawings) between the stretch roll 28 and a separating roll 28*a* mounted thereon to form entanglements of filaments in the yarn.

The drawing-twisting texturing speed may be set appropriately, but it is preferable that the speed is in the range from 400 m/min to 1,500 m/min. At the preheating by the heating roll 22, the yarn is not yet twisted, but it is heated uniformly above the glass transition temperature, followed by false twisting. This leads to enhanced processing stability and makes it possible to produce a false twist yarn with substantially uniform quality.

When an ultra fine synthetic fiber yarn consisting of filaments each of which fineness (SD) is of not more than 1.2 dtex, or when a yarn consisting of filaments mixed with filaments having a different cross section and different orientation caused by the different figure is used, it is preferred to form tangles in the yarn before it is heated by the heating roll 22.

Figure 4:
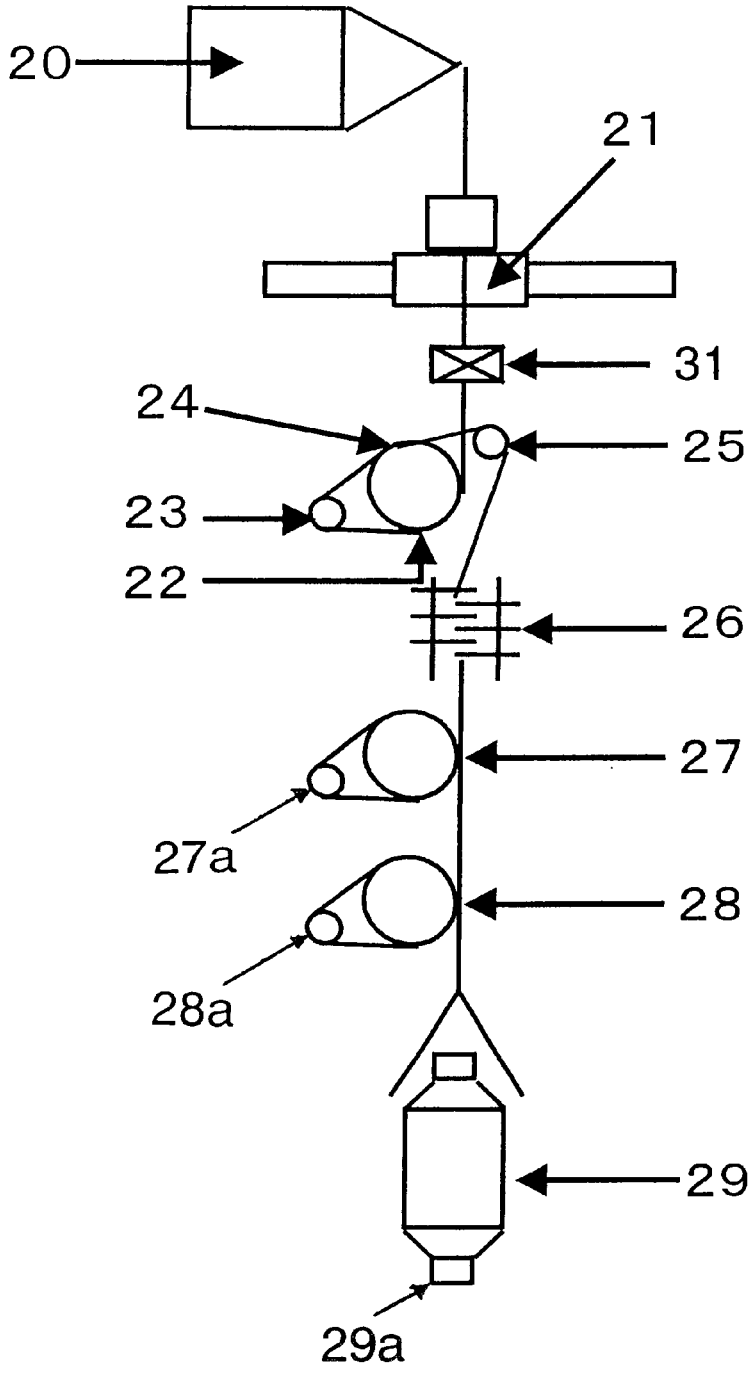
FIG. 4 is a schematic view of another apparatus for implementing a method for producing a false twist yarn of the invention.

FIG. 4 shows a method and apparatus for producing a false twist yarn of the invention, into which the entangling process is introduced.

In FIG. 4, the undrawn synthetic fiber yarn 20 is entangled by a entangling means 31 provided between the feed roll 21 and the heating roll 22. This entangling treatment promotes a compactness property between the filaments in the undrawn yarn 20, and also serves to control concentration of heat during heating and concentration of stress during drawing and twisting in the filaments. This prevents formation of fluff in the yarn, resulting in formation of uniform crimps in the yarn.

It is preferable that a fineness of filament in the undrawn synthetic fiber yarn 20 is not more than 1.2 dtex for enhancing compactness property of filaments and reducing concentration of heat during heating or concentration of stress during drawing and as the result for preventing formation of fluff.

When using a yarn consisting of at least two kinds of filaments different in figures of cross section, it is preferable that an entanglement is imparted to the yarn before twisting for randomizing arrangement of filaments having different orientations. It brings prevention of stress deviation between filaments during twisting and production of a false twist yarn having good crimp formation properties.

It is preferable that the yarn is reheated between the twist stopping means 25 and the false twisting means 26 to enhance twist fixation ability to achieve desired crimp properties.

Figure 5:
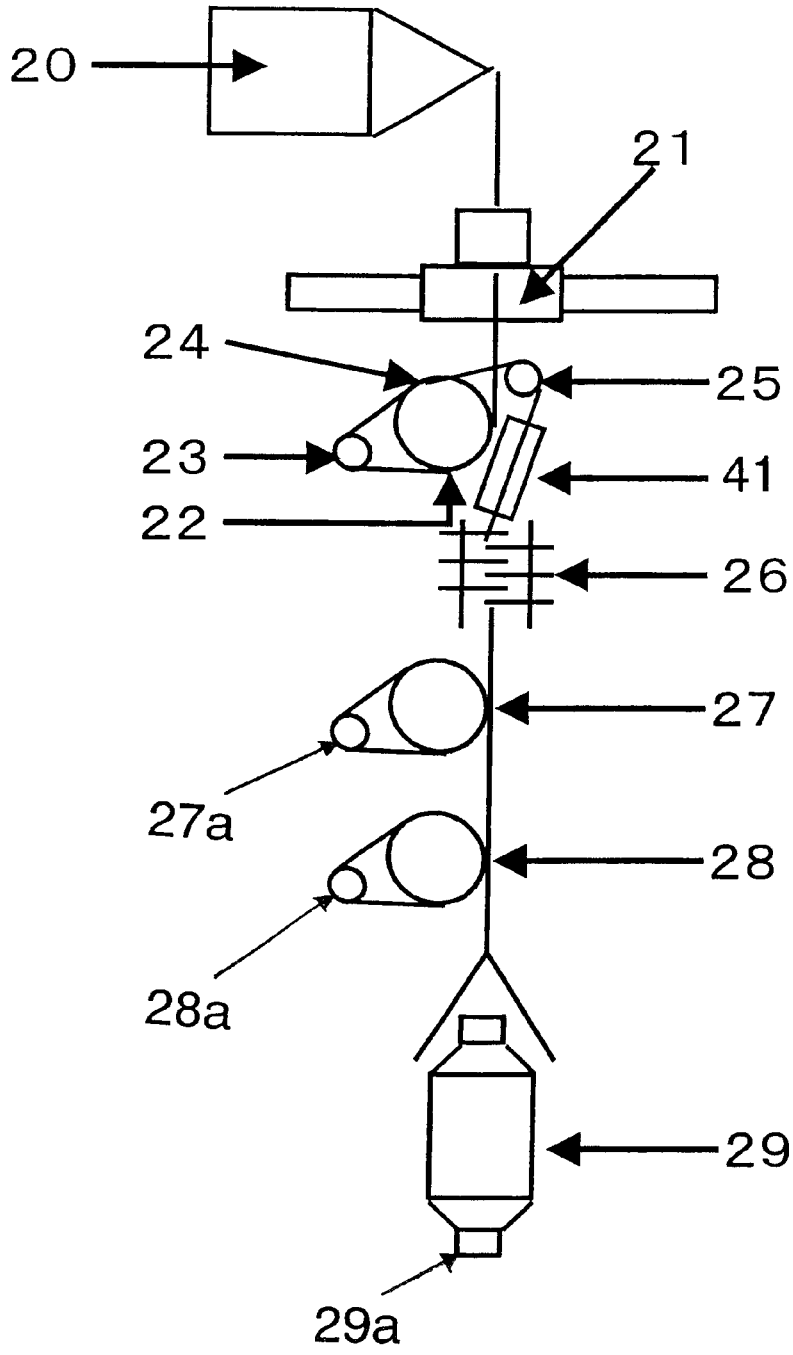
FIG. 5 is a schematic view of another apparatus for implementing a method for producing a false twist yarn of the invention.

FIG. 5 shows a method and apparatus for producing a false twist yarn of the invention, into which the reheating process is introduced.

In FIG. 5, the undrawn synthetic fiber yarn 20 is heated by a reheater 41 that is provided between the twist stopping means 25 and the false twisting means 26. This reheating enhances twist fixation ability of the yarn. By setting the reheating temperature at in a range from room temperature up to a temperature where the synthetic fiber yarn starts to be fused, the twist fixation ability may be set to an appropriate degree selected from a wide range in order to produce a false twist yarn with desired crimp properties.

Reheater 41 may be either a contact heating type device, in which the yarn comes in contact with the heating element, or a non-contact heating type device, in which the yarn passes through a heating atmosphere.

Figure 6:
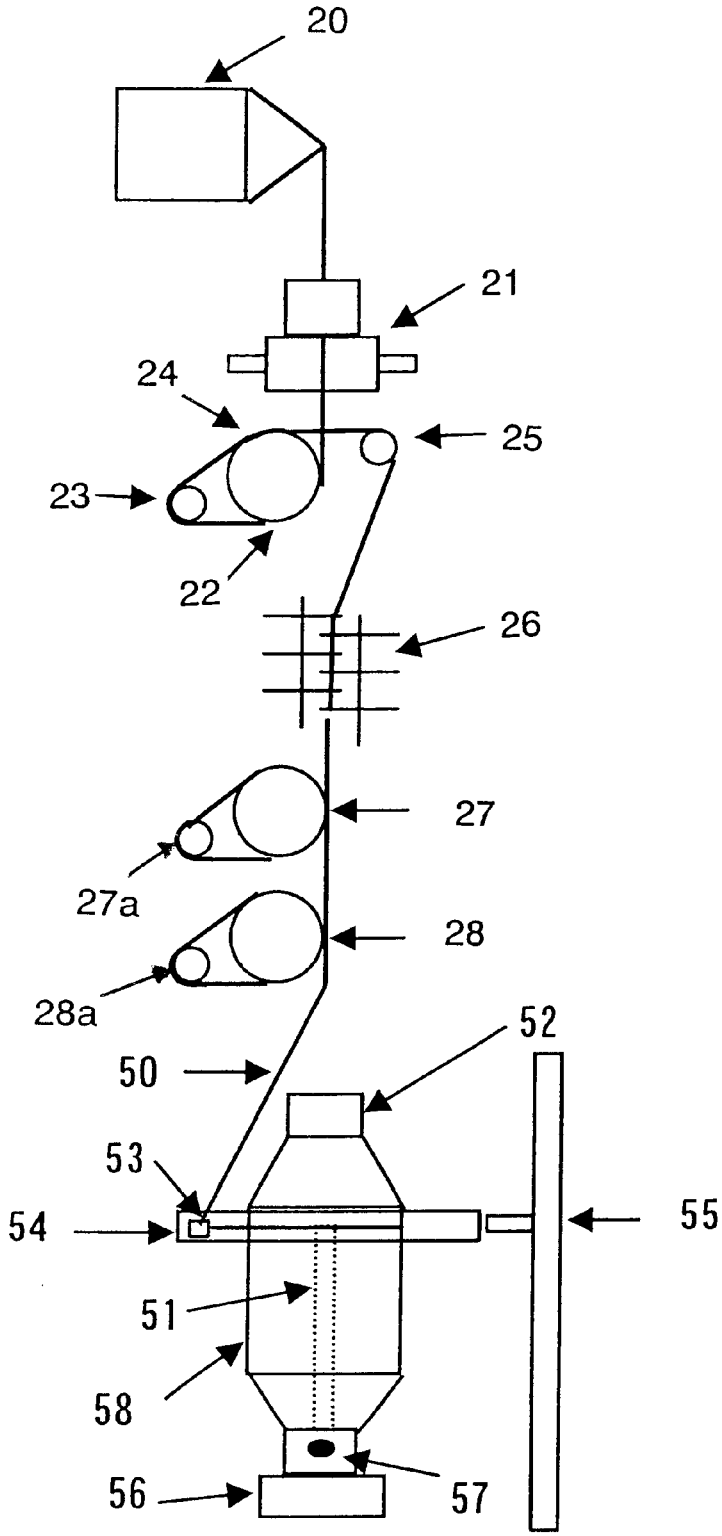
FIG. 6 is a schematic view of another apparatus for implementing a method for producing a false twist yarn of the invention.

FIG. 6 shows an outline of a pirn-winding type apparatus which is used preferably to implement a method for producing a false twist yarn of the invention.

In FIG. 6, a spindle wind-up machine that winds up a false twist yarn 50 into a pirn comprises a spindle 51, which rotates while in contact with a rotating belt (not shown in the drawing). The spindle 51 is equipped with a bobbin 52, which is rotated by the rotation of the spindle 51.

A traverse guide 53, which guides the false twist yarn 50 that is fed from the stretch roll 28, are supported by a traverse ring 54 in a rotatable manner. The traverse ring 54 is moved up and down by a hoist 55 with a set traverse distance.

The spindle 51 rotates, and the false twist yarn 50 is guided by the traverse guide 53. The false twist yarn 50 is wound on the bobbin 52 to form a pirn 58.

When winding of the false twist yarn 50 is stopped after the formation of the pirn 58, the traverse ring 54 is moved down below the bottom of the bobbin 52, i.e., down to the position of a waste roller 56, irrespective of the traverse position of the traverse guide 53, and feeding the false twist yarn 50 is stopped, after the traverse ring 54 has moved down and stopped.

Figure 7:
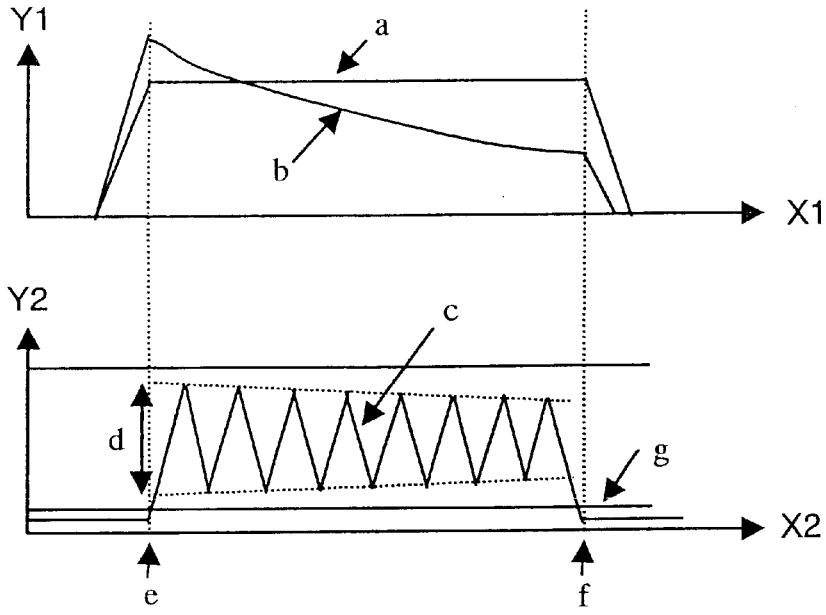
FIG. 7 is a graph showing the movement of a traverse guide during implementation of the method for producing a false twist yarn of the invention.

FIG. 7 shows an example of a position of the traverse ring 54, i.e., the position of the traverse guide 53 in the axial direction of spindle 51, during the period from start to end of winding. In the upper graph in FIG. 7, the horizontal axis X1 is time and the vertical axis Y1 is speed, and in the lower graph in FIG. 7, the horizontal axis X2 is time and the vertical axis Y2 is a position of the traverse guide.

In FIG. 7, lines a, b and c represent the change in yarn processing speed, the change in the rotating speed of the spindle 51, and the position of traverse guide 53, respectively.

First, at starting point e of winding, traverse width d is set to a maximum value, and in this state, the false twist yarn 50 is wound on the bobbin 52.

After that, the traverse width d is gradually decreased. The rotating speed of the spindle 51 decreases gradually because the speed of the false twist yarn being wound increases as the yarn is wound on bobbin 52. The decrease in the rotating speed of the spindle 51 is controlled to form a desirable wind-up shape to suit the wind-up method used, i.e., whether a constant yarn speed method or a constant wind-up tension method is used.

At finishing point f of winding, the traverse guide 53 is moved down to a position below bottom g of the bobbin 52 and maintained there. During the period, the yarn processing speed and the rotating speed of the spindle 51 are decreased to stop the take-up of the false twist yarn 50.

Winding is stopped when the traverse guide 53 has reached a position below the bottom g of the bobbin 52, but winding may be stopped at any time after the traverse guide 53 has reached a position below the bottom g of the bobbin 52.

As the bobbin 52 is moved up subsequently by a doffer (not shown in the drawing), the portion of the yarn between the bobbin 52 and the waste roller 56 is pulled and hooked on a yarn grip 57, and held there.

Figure 8A:
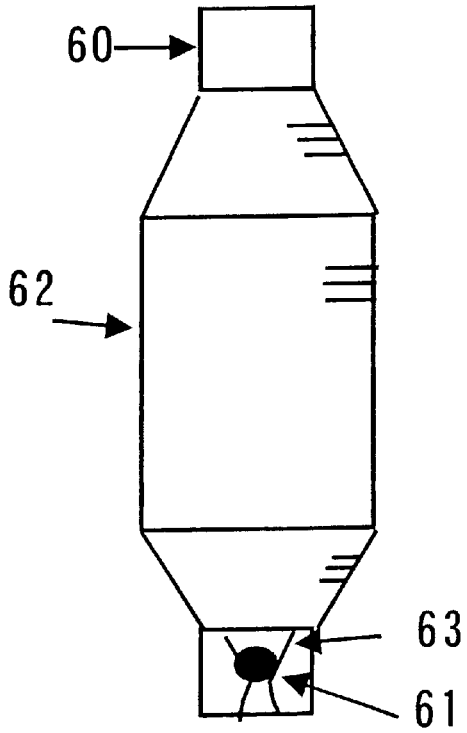
FIG. 8A is a front elevational view of a pirn-winding bobbin providing one yarn end gripping means, which is used to practice the method for producing a false twist yarn of the invention.
Figure 8B:
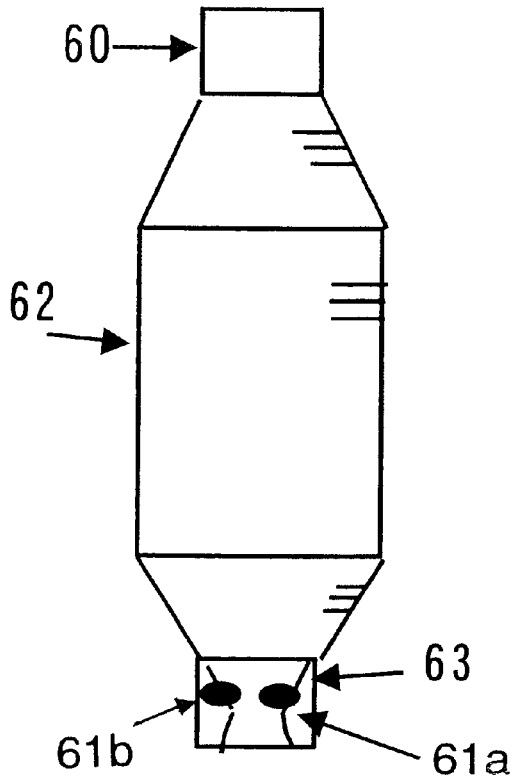
FIG. 8B is a front elevational view of a pirn-winding bobbin providing two yarn end gripping means, which is used to practice the method for producing a false twist yarn of the invention.

The yarn end captured is shown in FIGS. 8A and 8B.

In FIG. 8A, the yarn end 63 from the pirn 62 produced on the bobbin 60 has been captured by a yarn end grip 61 provided on the bottom surface of the bobbin 60. In this state, the yarn may be severed with scissors at a point between the yarn end grip 61 and the waste roller 56, or the yarn may be torn off at a point between the yarn end grip 61 and the waste roller 56 after moving up the bobbin 60.

As shown in FIG. 8A, only one yarn end grip 61 may be used to hold both front end and rear end 63 of the yarn, or as shown in FIG. 8B, two yarn end grips 61*a* and 61*b* may be used to hold the front end and the rear end of the yarn separately.

Thus, by moving the traverse guide 53 (FIG. 6) down to a position below the bottom g (FIG. 7) of the bobbin 52 or 60 and stopping it there, the false twist yarn 50 is taken up by the waste roller 56 (FIG. 6) when winding finishes to prevent the false twist yarn with different crimp properties from being wound into the pirn 58 or 62.

EXAMPLES

Measuring method and evaluation method:

Torque twist number (unite: twist number/50 cm):

With an initial load applied to an end of a sample, a specimen 100 cm long is taken, and a constant load is applied to the center of the specimen. With the constant load maintained, both ends of the specimen are held, and the specimen is folded at the center. It is then hung free, and left until the torque twist becomes stable. Subsequently, the yarn is untwisted with a twist counter, and the number of revolutions is counted until the two portions of the folded yarn become parallel. The initial and constant loads are expressed as a function of fineness of yarn by the following equations.

$$\text{Initial load } (cN) = (\text{fineness (dtex)}/1.111) \times 0.1 \times 0.9807$$

$$\text{Constant load } (cN) = (\text{fineness (dtex)}/1.11) \times 0.02 \times 0.9807$$

Dyeing method and fabric evaluation method:

A false twist yarn produced in an example or comparative example is knitted into a tube 35 cm long with a Koike Machinery Works single tubular knitting machine (gauge: 20), and dyed with an automatic pad-roll dyeing machine. Relative to the weight of the specimen, a solution of 0.3% owf dye, 5.0% owf assistant (Tetorosin), and 1.0% owf assistant (Sunsolt) is prepared. The solution is used to dye the tube specimen at 95° C. for 20 minutes, followed by rinsing and drying of the dyed specimen. The resultant specimen is subjected to functional evaluation in terms of bulkiness and soft feeling, and graded in one of five classes. The specimen is accepted if it falls into Grade 3 or higher.

A specimen of plain weave fabric is prepared using, as a warp, a drawn polyester yarn that is 33 dtex in fineness, non-crimped, made up of 12 filaments, and having a circular cross section, as a weft, a false twist yarn produced in an example or a comparative example. The resultant specimen is subjected to functional evaluation in terms of puffy touch and drape, and graded at one of five classes. The specimen is accepted if it falls into Grade 3 or higher.

Method for evaluating false twist processability:

A total of 500 drums (bobbins), each contains 3.5 kg of wound undrawn synthetic yarn, are used to produce drums (bobbins), each containing 3.0 kg of wound false twist yarn. The false twist processability (%) is defined as the proportion of the false twist yarns that are free of filament breaks and fluff. The specimen is accepted if the false twist processability is 99.0% or more.

Method for evaluating fluff number:

A Toray Engineering Co., Ltd. Model MFC-111-0 Multi Point Flay Counter is used to count the number of fluffs in a false twist yarn specimen running at a speed of 400 n/min for 5 minutes. The fluff number is defined as the average of measurements taken for 50 false twist yarn specimens. The yarn is accepted if the fluff number is 0.50/2,000 m or less.

Example 1

A 36-hole spinning nozzle was used to spin an undrawn polyethylene terephthalate yarn at a spinning speed of 3,000 m/min. The resultant yarn was drawn while being false twisted by false twisting means 26 under the conditions of a temperature of the heating roll 22 of 100° C., a draw ratio of 1.69, the number of false twist of 3,500/m, and processing speed of 600 m/min. Entanglement was achieved between the take-up roller 27 and the stretch roller 28 and the yarn was wound in a form of pirn 29. A false twist yarn having 84 dtex was produced.

The elongation (EL) of the false twist yarn was 30%, the crimp rigidity (CR) 13%, the crimp appearance stretch ratio (TR) 0.7%, the dry heat shrinkage stress maximum value (MCS) 0.2 cN/dtex, the deformation degree of single filament (SDD) 1.44, and the boiling water shrinkage percentage 22%.

As Comparative Examples 1–8, specimens for evaluation were prepared as shown in Table 1 under different sets of conditions for draw ratio, temperature of heating roll, number of false twists, and temperature of the take-up roller. These yarns were used as the weft while a drawn polyester yarn that was 33 dtex in fineness, non-crimped, and made up of 6 filaments with a circular cross section was used as the warp to produce plain weave fabric specimens, which were dyed and finished. In feeling evaluation, specimens produced from a false twist yarn of the invention were found to have an agreeable soft feeling.

Characteristics of the yarns produced in Example 1 and Comparative Examples 1–8 are shown in Table 1.

TABLE 1

| | Example | Comparative Example | | | | | | | |
|---|---|---|---|---|---|---|---|---|---|
| | 1 | 1 | 2 | 3 | 4 | 5 | 6 | 7 | 8 |
| Elongation (EL)(%) | 30 | 15 | 55 | 30 | 30 | 30 | 30 | 30 | 30 |
| Crimp rigidity (CR)(%) | 13 | 13 | 13 | 0.9 | 50 | 13 | 13 | 13 | 0.9 |
| Crimp appearance stretch ratio (TR)(%) | 0.7 | 0.7 | 0.7 | 0.3 | 20 | 20 | 20 | 20 | 20 |
| Dry heat shrinkage stress maximum value (MCS)(cN/dtex) | 0.20 | 1.00 | 0.08 | 0.20 | 0.20 | 0.20 | 0.20 | 0.20 | 0.20 |
| Deformation degree of single filament (SDD) | 1.44 | 1.44 | 1.44 | 1.20 | 2.10 | 1.44 | 1.44 | 1.44 | 1.20 |
| Entanglement number (EN) | 10 | 10 | 10 | 10 | 10 | 2 | 60 | 10 | 10 |
| Real twist number (RT) (t/m) | 8 | 8 | 8 | 8 | 8 | 8 | 8 | 3 | 18 |
| Soft feeling *1 | A | B | B | B | C | A | A | A‘ | C |

TABLE 1-continued

| | Example | Comparative Example | | | | | | | |
|---|---|---|---|---|---|---|---|---|---|
| | 1 | 1 | 2 | 3 | 4 | 5 | 6 | 7 | 8 |
| Fluff in raw yarn *2 | 0 | 10 | 5 | 0 | 0 | 0 | 0 | 0 | 0 |
| Pulling property *3 | 0 | 10 | 10 | 0 | 0 | 5 | 0 | 4 | 0 |

*1: A, B, and C represent "excellent", "good", and "stiff", respectively.
*2: Number of fluff per 2,000 m.
*3: Number of filament break per 1,000 m
"A'" for soft feeling evaluation represents judgment in terms of abnormal luster feeling (iratsuki in Japanese).

Example 2

A 36-hole spinning nozzle was used to spin an undrawn polyethylene terephthalate yarn at a spinning speed of 3,000 m/min. The resultant yarn was drawn while being false twisted by the false twisting means 26 under the following conditions: a temperature of the heating roll of 100° C., a draw ratio of 1.69, the number of false twists of 3,500/m, and processing speed of 600 m/min. Entanglement was achieved between the take-up roller 27 and the stretch roller 28 to produce a 84 dtex false twist yarn wound in pirn 29.

The elongation (EL) of the false twist yarn was 30%, the crimp rigidity (CR) 20%, the crimp appearance stretch ratio (TR) 3%, the dry heat shrinkage stress maximum value (MCS) 0.2 cN/dtex, the deformation degree of single filament (SDD) 1.44, and the boiling water shrinkage percentage 22%.

The false twist yarn obtained was additionally twisted at a rate of 1,000 t/m. A plain weave fabric specimen was produced using the additionally twisted yarn as the weft and using a non-crimped drawn polyester yarn of 33 dtex, 6 filaments each of which had a circular cross section, as the warp. The specimen was then dyed and finished.

Figure 10:
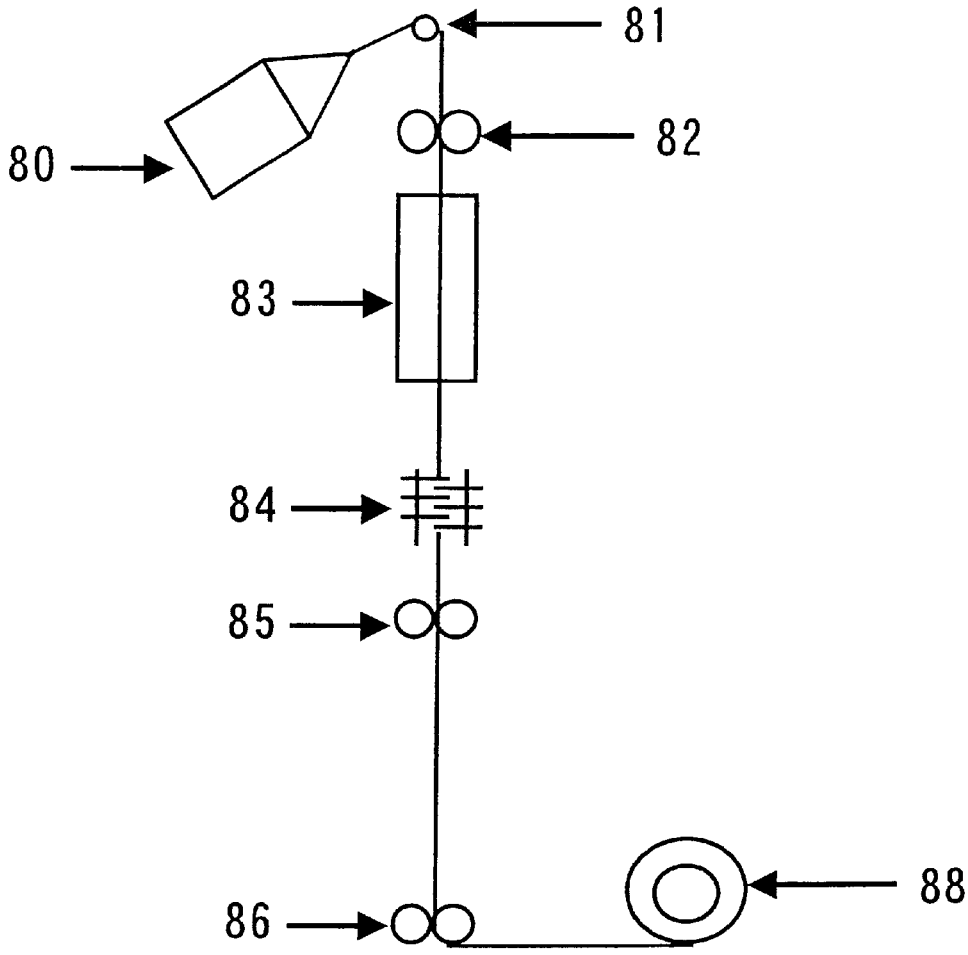
FIG. 10 is a schematic view of an apparatus for implementing a conventional method for producing a false twist yarn.

As a comparative example, undrawn polyethylene terephthalate yarn 80 was drawn while being false twisted by a conventional false twister as shown in FIG. 10 under the following conditions: a false twist yarn heater 83 of 210° C., a draw ratio of 1.80, a processing speed of 600 m/min, and a rotating speed of the disk in false twister 84 of 7,000 rpm. The apparatus in FIG. 10 also includes conventional components such as package 80, roller 81, rollers 82, 85, 86 and package 88. The resultant 85.0 dtex yarn made up of 36 filaments was further twisted at a rate of 1,000 t/m. A plain weave fabric specimen was produced using the yarn as the weft and using a 33 dtex non-crimped drawn polyester yarn that consisted of 6 filaments with a circular cross section, as the warp. The specimen was then dyed and finished. Fabric produced from a false twist yarn of the invention was found to be better in flexibility than the fabric produced in the comparative example.

Example 3

Using antimony trioxide as a polymerization catalyst, polyethylene terephthalate (PET) with a intrinsic viscosity of 0.65 (measured in oxo-chlorphenol solvent at 25° C.) was produced from terephthalic acid and ethylene glycol. The solution contained, as a delustering agent, 0.4 wt % titanium oxide with an average primary particle diameter of 0.5 $\mu$m. The polymer obtained was melt-spun at a spinning temperature of 284° C. and spinning speed of 3,000 m/min to produce a 134.0 dtex hollow undrawn yarn (POY) made up of 36 filaments. The hollow percentage (HR) of the undrawn yarn obtained was 17.8%.

A 84.0 dtex 36-filament false twist yarn in the form of 3.0 kg pirn 29 was produced from the hollow undrawn yarn (POY) with a continuous drawing and false twisting machine as shown in FIG. 3 operating with the heating roll 22 having a temperature of 100° C., the take-up roll 27 having a temperature of room temperature, the draw ratio of 1.6, and the drawing speed of 820 m/min, using a rotating roller guide as twist stopping means 25, using a three pivots friction disk false twister with a disk rotating speed of 6,650 rpm as false twisting means 26, giving tangles to the yarn with an air entanglement nozzle with an air pressure of 0.294 MPa provided between the stretch roll 28 and the separating roll 28*a*, and using a spindle wind-up machine to produce a pirn.

The hollow filaments contained in the resultant false twist yarn accounted for 37.5% of all single yarns and had a hollow percentage (HR) of 7.8%, the deformation degree of single filament (SDD) of 1.28, the elongation (EL) of 45%, the crimp rigidity (CR) of 28%, the crimp appearance stretch ratio (TR) of 5.6%, the dry heat shrinkage stress maximum value (MCS) of 0.16 cN/dtex, and the entanglement number (EN) of 12.

Fabric was produced and evaluated. It was graded in Grade 5 in terms of lightweight properties, bulkiness, soft feeling, and drape properties, indicating that excellent puffy fabric was obtained.

The out-drawing and false texturing process performed under the above conditions was free of retroaction of twist toward the heating roll 22, and the false twisting processability was a high of 99.8%. Furthermore, the resultant pirn 29 was free of fluff, and the fluff number was 0/2,000 m.

Example 4

A false twist yarn was produced under the same conditions as in Example 3 except that the draw ratio was 1.65. The hollow filaments contained in the resultant false twist yarn accounted for 34.5% of all single yarns and had a hollow percentage (HR) of 6.6%, a deformation degree of single filament (SDD) of 1.61, an elongation (EL) of 38%, a crimp rigidity (CR) of 31%, a crimp appearance stretch ratio (TR) of 6.5%, a dry heat shrinkage stress maximum value (MCS) of 0.17 cN/dtex, and an entanglement number (EN) of 10.

Fabric was produced and evaluated. It was rated Grade 4 in terms of lightweight properties, soft feeling, and drape properties, and Grade 5 in terms of bulkiness, indicating that excellent puffy cloth with a high bulkiness was obtained. The out-drawing and false texturing process performed under the above conditions was free of retroaction of twist toward the heating roll 22, and the false twisting processability was a high of 99.2%. Furthermore, the resultant pirn 29 was free of fluff, and the fluff number was 0.06/2,000 m.

Example 5

A false twist yarn was produced under the same conditions as in Example 3 except that the temperature of the heating roll 22 was 110° C. The hollow filaments contained in the resultant false twist yarn accounted for 31.8% of all single yarns and had a hollow percentage (HR) of 6.2%, a deformation degree of single filament (SDD) of 1.78, an elongation (EL) of 43%, a crimp rigidity (CR) of 33%, a crimp appearance stretch ratio (TR) of 4.0%, a dry heat shrinkage stress maximum value (MCS) of 0.18 cN/dtex, and an entanglement number (EN) of 12.

Cloth was produced and evaluated. It was rated Grade 4 in terms of lightweight properties, soft feeling, and bulkiness, and Grade 5 in terms of drape properties, indicating that excellent puffy cloth with good drape properties was obtained. The out-drawing and false texturing process performed under the above conditions was free of retroaction of twist toward the heating roll 22, and the false twisting processability was a high 99.6%. Furthermore, the resultant pirn 29 was free of fluff, and the fluff number was 0.02/2,000 m.

Characteristics of the yarns produced in Examples 3–5 are shown in Table 2.

TABLE 2

| | Example | | |
|---|---|---|---|
| | 3 | 4 | 5 |
| Hollow percentage of undrawn yarn (%) | 17.8 | 17.8 | 17.8 |
| Content of hollow filaments in false twist yarn (%) *1 | 37.5 | 34.5 | 31.8 |
| Hollow percentage in false twist yarn (HR) (%) | 7.8 | 6.6 | 6.2 |
| Deformation degree of single filament (SDD) | 1.28 | 1.61 | 1.78 |
| Yarn properties | | | |
| Elongation (EL) (%) | 45 | 38 | 43 |
| Crimp rigidity (CR) (%) | 28 | 31 | 33 |
| Crimp appearance stretch ratio (TR) (%) | 5.6 | 6.5 | 4.0 |
| Dry heat shrinkage stress maximum value(MCS)(cN/dtex) | 0.16 | 0.17 | 0.18 |
| Entanglement number (EN) | 12 | 10 | 12 |
| Cloth evaluation | | | |
| Puff properties | 5 | 4 | 4 |
| Bulkiness | 5 | 5 | 4 |
| Soft feeling | 5 | 4 | 4 |
| Drape properties | 5 | 4 | 5 |
| False twisting processability (%) | 99.8 | 99.2 | 99.6 |
| Fluffing (number/2000 m) | 0.00 | 0.06 | 0.02 |

*1: (Number of hollow filaments)/(number of total filaments) × 100

Example 6

The false twist yarn produced in Example 3 was additionally twisted at a rate of 1,000 t/m. The yarn obtained was used as the weft while a 33 dtex non-crimped drawn polyester yarn that consisted of 6 filaments with a circular cross section as the warp to produce a plain weave fabric specimen, followed by dyeing and finishing. The fabric specimen was subjected to functional evaluation in terms of light touch and flexibility, and rated at one of five classes. The specimen was accepted if it fell into Grade 3 or higher.

The fabric obtained was rated Grade 4 in terms of light touch, and Grade 5 in terms of flexibility, indicating that the fabric had good flexibility properties.

Example 7

Using antimony trioxide as a polymerization catalyst, polyethylene terephthalate (PET) with a intrinsic viscosity of 0.65 (measured in oxo-chlorphenol solvent at 25° C.) was produced from terephthalic acid and ethylene glycol. The solution contained, as a delustering agent, 0.4 wt % titanium oxide with an average primary particle diameter of 0.5 $\mu$m. The polymer obtained was melt-spun at a spinning temperature of 284° C. and spinning speed of 3,000 m/min, and a 131.5 dtex, 24-filament hollow undrawn combined filament yarn (POY) consisting of 12 filaments each of which had a circular cross section and 12 filaments each of which had a six-leaf cross section was produced. The hollow percentage (HR) of the undrawn yarn obtained was 17.8%.

A 84.0 dtex 24-filament false twist yarn in the form of 3.0 kg pirn 29 was produced from said hollow undrawn yarn (POY) with a continuous drawing and false twisting machine as shown in FIG. 3 operating with the heating roll 22 having a temperature of 100° C., the take-up roll 27 having a temperature of room temperature, a draw ratio of 1.6, and a drawing speed of 820 m/min, using a rotating roller guide as the twist stopping means 25, using a three pivots friction disk false twister with a disk rotating speed of 6,900 rpm as false twisting means 27, giving tangles to the yarn with an air entanglement nozzle with an air pressure of 0.294 MPa provided between the take-up roll 27 and the stretch roll 28, and using a spindle wind-up machine to produce a pirn.

The resultant false twist yarn had a modifiability degree (L/r) of 2.01, a deformation degree (SDD) of 1.34, an elongation (EL) of 39%, a crimp rigidity (CR) of 25%, a crimp appearance stretch ratio (TR) of 2.7%, a dry heat shrinkage stress maximum value (MCS) of 0.14 cN/dtex, and an entanglement number (EN) of 23.

Cloth was produced and evaluated. It was rated Grade 5 in terms of dry feeling, bulkiness, soft feeling, and drape properties, indicating that excellent cloth with good dry feeling was obtained.

The out-drawing and false texturing process performed under the above conditions was free of retroaction of twist toward the heating roll 22, and the false twisting processability was a high 99.8%. Furthermore, the resultant pirn 29 was free of fluff, and the fluff number was 0/2,000 m.

Example 8

A false twist yarn was produced under the same conditions as in Example 7 except that the draw ratio was 1.66. The resultant false twist yarn had a modifiability degree (SDD) of 2.33, a deformation degree (SDD) of 1.67, an elongation (EL) of 35%, a crimp rigidity (CR) of 26%, a crimp appearance stretch ratio (TR) of 2.8%, a dry heat shrinkage stress maximum value (MCS) of 0.15 cN/dtex, and an entanglement number (EN) of 18.

Cloth was produced and evaluated. It was rated Grade 4 in terms of dry feeling and drape properties, and Grade 5 in terms of, soft feeling and bulkiness, indicating that soft, bulky cloth with good dry feeling and drape properties was obtained.

The out-drawing and false texturing process performed under the above conditions was free of retroaction of twist toward the heating roll 22, and the false twisting processability was a high 99.6%. Furthermore, the resultant pirn 29 was free of fluff, and the fluff number was 0.04/2,000 m.

Characteristics of the yarns produced in Examples 7–8 are shown in Table 3.

| | Example | |
|---|---|---|
| | 7 | 8 |
| Modifiability degree (L/r) | 2.01 | 2.33 |
| Deformation degree of single filament (SDD) | 1.34 | 1.67 |
| Yarn properties | | |
| Elongation (EL) (%) | 39 | 35 |
| Crimp rigidity (CR) (%) | 25 | 26 |
| Crimp appearance stretch ratio (TR) (%) | 2.7 | 2.8 |
| Dry heat shrinkage stress maximum value (MCS)(cN/dtex) | 0.14 | 0.15 |
| Entanglement number (EN) | 23 | 18 |
| Cloth evaluation | | |
| Dry feeling | 5 | 4 |
| Bulkiness | 5 | 5 |
| Soft feeling | 5 | 5 |
| Drape properties | 5 | 4 |
| False twisting processability (%) | 99.8 | 99.6 |
| Fluffing (number/2000 m) | 0.00 | 0.04 |

Example 9

The false twist yarn produced in Example 7 was additionally twisted at a rate of 1,000 t/m. The yarn obtained was used as the weft while a 33 dtex non-crimped drawn polyester yarn that consisted of 6 filaments with a circular cross section was used as the warp to produce a plain weave fabric specimen, followed by dyeing and finishing.

The fabric specimen was subjected to functional evaluation in terms of dry feeling and flexibility, and rated in one of five classes. The specimen was accepted if it fell into Grade 3 or higher. The fabric obtained was rated Grade 5 in terms of dry feeling and Grade 5 in terms of flexibility, indicating that the fabric had good dry feeling and flexibility properties.

Example 10

Plain weave fabric was produced by the same procedure as in Example 9 except that the false twist yarn obtained in Example 8 was used, and cloth evaluation was carried out.

The cloth obtained was rated Grade 4 in terms of dry feeling and Grade 5 for flexibility, indicating that the cloth had a good dry feeling.

Example 11

Using antimony trioxide as a polymerization catalyst, polyethylene terephthalate (PET) with a intrinsic viscosity of 0.65 (measured in oxo-chlorphenol solvent at 25° C.) was produced from terephthalic acid and ethylene glycol. The solution contained, as a delustering agent, 0.4 wt % titanium oxide with an average primary particle diameter of 0.5 $\mu$m. The polymer obtained was melt-spun at a spinning temperature of 284° C. and spinning speed of 3,000 m/min to produce a 150.0 dtex undrawn yarn (POY) made up of 36 filaments.

A 93.5 dtex 36-filament false twist yarn in the form of 3.0 kg pirn 29 was produced from said hollow undrawn yarn (POY) with an out-drawing and false texturing machine as shown in FIG. 3 operating with the heating roll 22 having a temperature of 110° C., the take-up roll 27 having a temperature of room temperature, a draw ratio of 1.69, and a drawing speed of 820 m/min, using a rotating roller guide as twist stopping means 25, using a three-pivots friction disk false twister with a disk rotating speed of 7,000 rpm as false twisting means 26, and using a spindle wind-up machine to produce a pirn.

The out-drawing and false texturing process performed under the above conditions was free of retroaction of twist toward the heating roll 22, and the false twisting processability was a high 99.8%. Furthermore, the resultant pirn 29 was free of fluff, and the fluff number was 0/2,000 m.

The resultant false twist yarn had the crimp rigidity (CR) of 33%, the crimp appearance stretch ratio (TR) of 2.8%, and the torque twist number of 2.4 t/50 cm.

Cloth was produced and evaluated, indicating that cloth with excellent bulkiness, soft feeling and drape properties had been produced.

Example 12

A false twist yarn was produced under the same conditions as in Example 11 except that the temperature of take-up roll 27 was 120° C. A 93.5 dtex 36-filament false twist yarn with a crimp rigidity (CR) of 20%, a crimp appearance stretch ratio (TR) of 1.3%, and a torque twist number of 0.5 t/50 cm was obtained.

As in Example 11, the yarn was free of retroaction of twist and broken filaments, and the false twist processability was 99.6%. Pirn 29 was free of fluffing, and the fluff number was 0.06/2,000 m.

Cloth produced from the resultant false twist yarn had good bulkiness, soft feeling and drape properties.

Comparative Example 9

A false twist yarn was produced under the same conditions as in Example 11 except that a nip roll was provided to serve as twist stopping means at the point 24 where the yarn was released from the heating roll. A 93.5 dtex 36-filament false twist yarn was obtained.

This process was intended to produce a false twist yarn of the same volume as in Example 11. However, retroaction of twist took place to cause single yarns to twine around the heating roll 22 or to cause the yarn to twine around the heating roll or false twister 25, resulting in scission. The false twist processability was a poor 82.6%, and the fluff number was 19.0/2,000 m.

Comparative Example 10

The same procedure for false twist yarn production as in Example 11 was followed except that a twist setter was not provided between the heating roll 22 and the false twisting means 26 was carried out in an attempt to obtain a false twist yarn of the same volume as in Example 11. However, the yarn was severed when it was inserted into the false twisting means 26, making it impossible to produce a false twist yarn.

Comparative Example 11

Using a conventional false twister as shown in FIG. 10, the same undrawn polyethylene terephthalate yarn as in Example 11 was subjected to an in-drawing and false texturing process under the following conditions: the false twisting heater 83 having a temperature of 210° C., a draw ratio of 1.80, a processing speed of 600 m/min, and the false twister 84 having disk revolving speed of 7,000 m. A 85.0 dtex 36-filament false twist yarn was obtained.

The resultant false twist yarn had a crimp rigidity (CR) of 48%, a crimp appearance stretch ratio (TR) of 34%, and a torque twist number of 86 t/50 cm, and also had a high crimp forming tendency. As a result, cloth evaluation showed that the cloth was poor in bulkiness, soft feeling, and drape properties.

Characteristics of the false twist yarns produced in Examples 11 and 12 and Comparative Examples 9–11 are shown in Tables 4 and 5.

TABLE 4

| | False twisting processability (%) | Fluffing (number/2000 m) |
|---|---|---|
| Example 11 | 99.8 | 0.00 |
| Example 12 | 99.6 | 0.06 |
| Comparative example 9 | 82.6 | 19.0 |
| Comparative example 10 | —(*1) | —(*1) |
| Comparative example 11 | 99.4 | 0.10 |

*1: The yarn cannot be set properly, making it impossible to evaluate its false twisting processability and fluffing.

TABLE 5

| | Example | | Comparative Example | | |
|---|---|---|---|---|---|
| | 11 | 12 | 9 | 10 | 11 |
| Crimp properties | | | | | |
| Crimp rigidity (CR)(%) | 33 | 20 | 36 | — | 48 |
| Crimp appearance stretch ratio(TR) (%) | 2.8 | 1.3 | 7.6 | — | 34 |
| Torque twist number (twists/50 cm) | 2.4 | 0.5 | 12 | — | 86 |
| Cloth evaluation | | | | | |
| Bulkiness | 5 | 4 | 3 | — | 2 |
| Soft feeling | 5 | 4 | 3 | — | 1 |
| Drape properties | 4 | 5 | 3 | — | 2 |

In cloth evaluation in Comparative Example 9, fluffing was found in the surface of both tube-knitted and plain weave specimens.
In Comparative Example 10, the yarn cannot be set properly, making it impossible to evaluate yarn properties and cloth properties.

Example 13

Using antimony trioxide as a polymerization catalyst, polyethylene terephthalate (PET) with a intrinsic viscosity of 0.65 (measured in oxo-chlorphenol solvent at 25° C.) was produced from terephthalic acid and ethylene glycol. The solution contained, as a delustering agent, 0.4 wt % titanium oxide with an average primary particle diameter of 0.5 $\mu$m. The polymer obtained was melt-spun at a spinning temperature of 284° C. and spinning rate of 3,000 m/min to produce a 126.0 dtex undrawn yarn (POY) made up of 72 filaments.

A 83.9 dtex 72-filament false twist yarn in the form of 3.0 kg pirn 29 was produced from the hollow undrawn yarn (POY) with an out-drawing and false texturing machine as shown in FIG. 4 operating at the heating roll 22 having a temperature of 100° C., the take-up roll 27 having a temperature of room temperature, a draw ratio of 1.53, and a drawing speed of 820 m/min, using an air entanglement nozzle with an air pressure of 0.196 MPa as entangling machine 31, using a rotating roller guide as twist stopping means 25, using a three pivots friction disk false twister with a disk rotating speed of 6,800 rpm as false twisting means 26, and using a spindle wind-up machine to produce a pirn.

The out-drawing and false texturing process performed under the above conditions was free of retroaction of twist toward the heating roll 22, and the false twisting processability was a high 99.6%. Furthermore, the resultant pirn 29 was free of fluff, and the fluff number was 0.02/2,000 m.

The resultant false twist yarn had a crimp rigidity (CR) of 26%, a crimp appearance stretch ratio (TR) of 2.9%, and a torque twist number of 3.1 t/50 cm. Cloth was produced and evaluated, and it was rated Grade 4 in terms of bulkiness and Grade 5 in terms of soft feeling and drape properties, indicating that the cloth had excellent properties.

Example 14

Using antimony trioxide as a polymerization catalyst, polyethylene terephthalate (PET) with a intrinsic viscosity of 0.65 (measured in oxo-chlorphenol solvent at 25° C.) was produced from terephthalic acid and ethylene glycol. The solution contained, as a delustering agent, 0.4 wt % titanium oxide with an average primary particle diameter of 0.5 $\mu$m. The polymer obtained was melt-spun at a spinning temperature of 284° C. and spinning rate of 3,000 m/min to produce a 131.0 dtex 48-filaments undrawn yarn (POY) made up of 24 filaments with a circular cross section and 24 filaments with a six-leaf cross section.

A 83.6 dtex 48-filament false twist yarn in the form of 3.0 kg pirn 29 was produced from the hollow undrawn yarn (POY) with an out-drawing and false texturing machine as shown in FIG. 4 operating with the heating roll 22 having a temperature of 100° C., the take-up roll 27 having a temperature of room temperature, a draw ratio of 1.59, and a drawing speed of 820 m/min, using an air entanglement nozzle with an air pressure of 0.196 MPa as entangling machine 31, using a rotating roller guide as twist stopping means 25, using a three pivots friction disk false twister with a disk rotating speed of 6,900 rpm as false twisting means 26, and using a spindle wind-up machine to produce a pirn.

The out-drawing and false texturing process performed under the above conditions was free of extension of twisting back to the heating roll 22, and the false twisting processability was a high 99.8%. Furthermore, the resultant pirn 29 was free of fluff, and the fluff number was 0/2,000 m.

The resultant false twist yarn had a crimp rigidity (CR) of 29%, a crimp appearance stretch ratio (TR) of 2.2%, and a torque twist number of 7.0 t/50 cm. Cloth was produced and evaluated, and it was rated Grade 5 in terms of bulkiness and soft feeling, and Grade 4 in terms of drape properties, indicating that the cloth had excellent bulkiness and soft feeling.

Characteristics of the false twist yarns produced in Examples 13 and 14 are shown in Tables 6 and 7.

TABLE 6

| | False twisting processability (%) | Fluffing (number/2,000 m) |
|---|---|---|
| Example 13 | 99.6 | 0.02 |
| Example 14 | 99.8 | 0.00 |

TABLE 7

| | Example 13 | Example 14 |
|---|---|---|
| Crimp properties | | |
| Crimp rigidity (CR) (%) | 26 | 29 |
| Crimp appearance stretch ratio (TR) (%) | 2.9 | 2.2 |
| Torque twist number (t/50 cm) | 3.1 | 7.0 |

TABLE 7-continued

| | Example 13 | Example 14 |
|---|---|---|
| Cloth evaluation | | |
| Bulkiness | 4 | 5 |
| Soft feeling | 5 | 5 |
| Drape properties | 5 | 4 |

Example 15

Using antimony trioxide as a polymerization catalyst, polyethylene terephthalate (PET) with a intrinsic viscosity of 0.65 (measured in oxo-chlorphenol solvent at 25° C.) was produced from terephthalic acid and ethylene glycol. The solution contained, as a delustering agent, 0.4 wt % titanium oxide with an average primary particle diameter of 0.5 $\mu$m. The polymer obtained was melt-spun at a spinning temperature of 284° C. and spinning rate of 3,000 m/min to produce a 150.0 dtex undrawn yarn (POY) made up of 36 filaments.

A 36-filament, 93.5 dtex false twist yarn in the form of 3.0 kg pirn 29 was produced from the hollow undrawn yarn (POY) with an out-drawing and false texturing machine as shown in FIG. 5 operating at the heating roll 22 having a temperature of 110° C., the take-up roll 27 having a temperature of room temperature, a draw ratio of 1.69, and a drawing speed of 820 m/min, using a heating plate as re-heater 41 with a re-heating temperature of 200° C., using a rotating roller guide as twist stopping means 25, using a three pivots friction disk false twister with a disk rotating speed of 7,000 rpm as false twisting means 26, and using a spindle wind-up machine to produce a pirn.

The out-drawing and false texturing process performed under the above conditions was free of retroaction of twist toward the heating roll 22, and the false twisting processability was a high 99.8%. Furthermore, the resultant pirn 29 was free of fluff, and the fluff number was 0/2,000 m.

The resultant false twist yarn had a crimp rigidity (CR) of 38%, a crimp appearance stretch ratio (TR) of 12.0%, and a torque twist number 7.0/50 cm. Cloth evaluation showed the cloth obtained had good bulkiness.

Example 16

A false twist yarn was produced under the same conditions as in Example 15 except that the temperature of reheater 41 was 50° C. The process was free of retroaction of twist toward the heating roll 22, and the false twisting processability was a high 99.6%. Pirn 29 obtained was free of fluffing, and the fluff number was 0/2,000 m.

The false twist yarn obtained had a crimp rigidity (CR) of 30%, a crimp appearance stretch ratio (TR) of 2.7%, and a torque twist number of 2.5/50 cm, and cloth evaluation showed that the cloth produced had excellent bulkiness, soft feeling, and drape properties.

Example 17

A false twist yarn was produced under the same conditions as in Example 16 except that the temperature of the take-up roll 27 was 120° C. A 93.5 dtex 36-filament false twist yarn with a crimp rigidity (CR) of 20%, a crimp appearance stretch ratio (TR) of 1.3%, and a torque twist number 0.5/50 cm was obtained.

As in Example 15, the yarn was free of retroaction of twist and scission, and the false twist processability was 99.6%. Pirn 29 was free of fluffing, and the fluff number was 0.06/2,000 m.

Cloth produced from the resultant false twist yarn had good bulkiness, soft feeling and drape properties.

Characteristics of the false twist yarns produced in Examples 15–17 are shown in Tables 8 and 9.

TABLE 8

| | False twisting processability (%) | Fluffing (number/2,000 m) |
|---|---|---|
| Example 15 | 99.8 | 0.00 |
| Example 16 | 99.6 | 0.00 |
| Example 17 | 99.6 | 0.06 |

TABLE 9

| | Example | | |
|---|---|---|---|
| | 15 | 16 | 17 |
| Crimp properties | | | |
| Crimp rigidity (CR) (%) | 38 | 30 | 20 |
| Crimp appearance stretch ratio (TR) (%) | 12 | 2.7 | 1.3 |
| Torque twist number (twists/50 cm) | 7.0 | 2.5 | 0.5 |
| Cloth evaluation | | | |
| Bulkiness | 5 | 4 | 4 |
| Soft feeling | 4 | 4 | 4 |
| Drape properties | 3 | 5 | 5 |

Example 18

Figure 9:
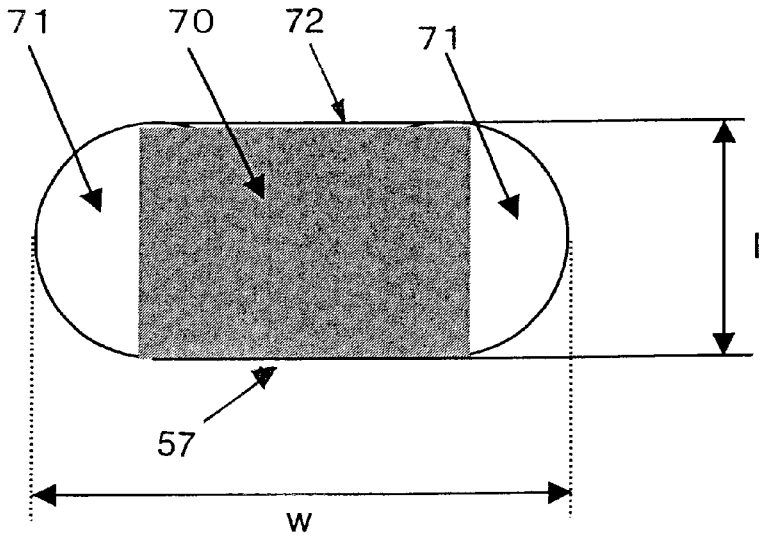
FIG. 9 is a plan view of a yarn end gripping means.

A piece of tape having adhesive portion 70 and paste-free portion 71 as shown in FIG. 9 was used as the yarn grip 57 (FIG. 6). The length (l) and the width (w) of the tape were 23 mm and 9 mm, respectively. One such yarn grip 57 was adhered to a pirn-free portion of the surface of the bobbin 52 below the pirn 58.

Using such bobbin 52 along with a pirn winder as shown in FIG. 6, a drawing and false texturing process was carried out to produce a 150 dtex 36-filament polyester fiber yarn, which was wound into the pirn 58.

After the completion of winding, a doffer was used to pull up the bobbin 52. The wind-start end of the yarn was found to be held between the right-hand paste-free portion and the surface of the bobbin 52, while the wind-finish end of the yarn was held between the left-hand paste-free portion and the surface of bobbin 52. As shown in FIG. 8B, when two pieces of tape were used, the wind-start end of the yarn was also found to be held between the right-hand paste-free portion of the tape adhered to the right side and the surface of the bobbin 52, while the wind-finish end of the yarn was held between the left-hand paste-free portion of the tape adhered to the left side and the surface of bobbin 52.

Industrial Applicability

The false twist yarns as proposed by the invention, and the method and apparatus for production thereof overcome the difficulty in producing products with uniform quality, which is attributable to poor uniformity among twists which is generally seen in conventional false twist yarns, and provide false twist yarn products with good features in terms of drape properties, soft feeling, bulkiness, flexibility, light-weight roperties, mild luster, and dry feeling. With such false twist yarns, it is possible to produce woven/knit fabrics with novel texture that cannot be achieved in conventional drawn or false twist yarns.

What is claimed is:

1. A false twist yarn comprising (i) a synthetic fiber yarn, wherein the yarn has (ii) an elongation (EL) of not less than 20% and not more than 50%, (iii) a crimp rigidity (CR) of not less than 10% and not more than 40%, (iv) a crimp appearance stretch ratio (TR) of not less than 0.5% and not more than 15%, (v) a dry heat shrinkage stress maximum value (MCS) of not less than 0.1 cN/dtex and not more than 1.0 cN/dtex, (vi) a deformation degree of single filament (SDD) of not less than 1.0 and not more than 2.5, and (vii) an entanglement number (EN) of not less than 4 and not more than 50, wherein the yarn has a real twist number of not less than 4 t/m and not more than 15 t/m.

2. A false twist yarn comprising (i) a synthetic fiber yarn, wherein the yarn has (ii) an elongation (EL) of not less than 20% and not more than 50%, (iii) a crimp rigidity (CR) of not less than 10% and not more than 40%, (iv) a crimp appearance stretch ratio (TR) of not less than 0.5% and not more than 15%, (v) a dry heat shrinkage stress maximum value (MCS) of not less than 0.1 cN/dtex and not more than 1.0 cN/dtex, (vi) a deformation degree of single filament (SDD) of not less than 1.0 and not more than 2.5, and (vii) an entanglement number (EN) of not less than 4 and not more than 50, wherein each of filaments forming not less than 30% of the yarn has a hollow percentage (HR) of 6% to 15%.

3. A false twist yarn comprising (i) a synthetic fiber yarn, wherein the yarn has (ii) an elongation (EL) of not less than 20% and not more than 50%, (iii) a crimp rigidity (CR) of not less than 10% and not more than 40%, (iv) a crimp appearance stretch ratio (TR) of not less than 0.5% and not more than 15%, (v) a dry heat shrinkage stress maximum value (MCS) of not less than 0.1 cN/dtex and not more than 1.0 cN/dtex, (vi) a deformation degree of single filament (SDD) of not less than 1.0 and not more than 2.5, and (vii) an entanglement number (EN) of not less than 4 and not more than 50, wherein the yarn comprises a mixture of filaments whose peripheral figure of cross section has no concave portion and whose peripheral figure of cross section has a concave portion, a deformation degree (SDD) of the filaments having no concave portion is 1.0 to 2.0, and a deformation degree (SDD) of the filaments having concave portion is 1.6 to 2.5.

4. The false twist yarn according to claim 1, 2 or 3, wherein the yarn is wound up in a pirn form on a bobbin and the starting portion of winding of the yarn and the finishing portion of winding of the yarn are held by at least one yarn gripping means provided on the bobbin.

5. A method for producing a false twist yarn comprising (i) an undrawn yarn feeding process that feeds an undrawn synthetic fiber yarn, (ii) a drawing and false twisting process that draws and false-twists the undrawn yarn fed from the undrawn yarn feeding process, and (iii) a false twist yarn winding process that winds up the false twist yarn produced by drawing and false twisting performed in the drawing and false twisting process, wherein (iv) the drawing and false twisting process contains a heater, a false twisting means, and a twist stopping means provided between the heater and the false twisting means, the undrawn yarn is heated by the heater while twisting motion imparted by the false twisting means on the undrawn yarn is restrained by the twist stopping means, and subsequently the heated drawn yarn, after passing through the twist stopping means, is false-twisted by the false twisting means with a starting point of twisting formed by the twist stopping means.

6. The method for producing a false twist yarn according to claim 5, wherein an entangling process that imparts tangles of filaments in the undrawn yarn, before the heating of the undrawn yarn by the heater is provided.

7. The method for producing a false twist yarn according to claim 5, wherein the fineness of filament (SD) in the undrawn yarn is not more than 1.2 dtex.

8. The method for producing a false twist yarn according to claim 5, wherein the undrawn yarn comprises at least two types of filaments with different cross sectional shapes.

9. The method for producing a false twist yarn according to claim 5, wherein a reheating process in which the yarn after passing through the twist stopping means is reheated between the twist stopping means and the false twisting means is provided.

10. The method for producing a false twist yarn according to claim 5, wherein a spindle having a vertical rotation axis, a bobbin mounted on the spindle, a yarn guide that rotates outside the bobbin to guide the false twist yarn onto the bobbin and a traverse guide that moves the yarn guide up and down along the rotation axis of the spindle to form a pirn on the bobbin and that produces yarn end portions on the bobbin at the starting and finishing of winding of the false twist yarn are provided in the false twist yarn winding process, and the starting and finishing portions of the false twist yarn are held by a yarn gripping means provided on the bobbin at positions corresponding to the positions of the starting and finishing portions of winding of the false twist yarn.

11. An apparatus for producing a false twist yarn comprising (i) an undrawn yarn feeding means that feeds undrawn synthetic fiber yarns, (ii) a drawing and false twisting means that draws and false twists the undrawn yarns fed from the undrawn yarn feeding means, and (iii) a false twist yarn winding means that winds up the false twist yarn produced by the drawing and false twisting performed by the drawing and false twisting means, wherein (iv) the drawing and false twisting means contains a heater, a false twisting means, and a twist stopping means provided between the heater and the false twisting means, the undrawn yarn is heated by the heater while twisting motion imparted by the false twisting means on the undrawn yarn is restrained by the twist stopping means, and subsequently the heated undrawn yarn, after passing through the twist stopping means, is false-twisted by the false twisting means with a starting point of twisting formed by the twist stopping means.

12. The apparatus for producing a false twist yarn according to claim 11, wherein an entangling means that imparts tangles of filaments in the undrawn yarn, is provided at a position before the heating of the undrawn yarn by the heater.

13. The apparatus for producing a false twist yarn according to claim 11, wherein a reheating means in which the yarn after passing through the twist stopping means is reheated between the twist stopping means and the false twisting means is provided.

14. The apparatus for producing a false twist yarn according to claim 11, wherein the false twist yarn winding means includes a spindle having a vertical rotation axis, a bobbin mounted on the spindle, a yarn guide that rotates outside the bobbin to guid the false twist yarn onto the bobbin, and a traverse guide that moves the yarn guide up and down along the rotation axis of the spindle to form a prin on the bobbin and that produces yarn end portions on the bobbin at the starting and finishing of winding of the false twist yarn, and the starting and finishing portions of the false twist yarn are held by a yarn gripping means provided on the bobbin at positions corresponding to the positions of the starting and finishing portions of winding of the false twist yarn.

* * * * *